US006300860B1

(12) United States Patent
Hofsäss

(10) Patent No.: US 6,300,860 B1
(45) Date of Patent: Oct. 9, 2001

(54) SWITCH HAVING AN INSULATING SUPPORT

(76) Inventor: Marcel Hofsäss, Höfener Strasse 29, Neuenbürg (DE)

( * ) Notice: Subject to any disclaimer, the term of this patent is extended or adjusted under 35 U.S.C. 154(b) by 0 days.

(21) Appl. No.: 09/416,607

(22) Filed: Oct. 12, 1999

(30) Foreign Application Priority Data

Oct. 13, 1998 (DE) ..... 198 47 209

(51) Int. Cl.[7] ..... H01H 37/14; H01H 37/04; H01H 37/52

(52) U.S. Cl. ..... 337/377; 337/380; 337/362; 337/100; 337/102; 337/333

(58) Field of Search ..... 337/362, 388, 337/389, 397, 333, 342, 343, 365, 372, 375, 377, 380, 390, 391, 361, 52, 53, 85, 89, 100–102, 131, 135, 141; 29/623

(56) References Cited

U.S. PATENT DOCUMENTS

| | | | | |
|---|---|---|---|---|
| 2,503,008 | * | 4/1950 | Taylor | 200/138 |
| 2,585,068 | * | 2/1952 | Wood | 200/113 |
| 3,265,839 | * | 8/1966 | Johnson | 200/122 |
| 3,443,259 | * | 5/1969 | Wehl et al. | 337/89 |
| 4,399,423 | * | 8/1983 | Nield | 337/102 |
| 4,476,452 | * | 10/1984 | D'Entremont | 337/102 |
| 4,636,766 | | 1/1987 | Carbone et al. . | |
| 4,862,132 | * | 8/1989 | Hollweck | 337/102 |
| 4,862,133 | * | 8/1989 | Tabei | 337/102 |
| 5,268,664 | * | 12/1993 | Givler | 337/380 |
| 5,309,131 | * | 5/1994 | Hofsass et al. | 337/102 |
| 5,367,279 | * | 11/1994 | Sakai | 337/104 |
| 5,428,336 | * | 6/1995 | Smith et al. | 337/365 |
| 5,489,726 | * | 2/1996 | Martin et al. | 219/510 |
| 5,607,610 | * | 3/1997 | Furukawa | 219/505 |
| 5,892,429 | | 4/1999 | Hofsäss . | |
| 5,973,587 | * | 10/1999 | Hofsass | 337/377 |
| 6,097,274 | * | 8/2000 | Hofsass | 337/362 |
| 6,133,817 | * | 10/2000 | Hofsass et al. | 337/377 |

FOREIGN PATENT DOCUMENTS 196 04 939 A1 8/1997 (DE) .

* cited by examiner

*Primary Examiner*—Leo P. Picard
*Assistant Examiner*—Anatoly Vortman
(74) *Attorney, Agent, or Firm*—Harness, Dickey & Pierce, P.L.C.

(57) ABSTRACT

A switch 10 has an insulating support 16 on which a first and a second external terminal 11, 14 are arranged, and a temperature-dependent switching mechanism 19 that, as a function of its temperature, makes between the first and the second external terminal 11, 14 an electrically conductive connection for an electrical current to be conducted through the switch 10, and having a switching member 22 that changes its geometric shape in temperature-dependent fashion between a closed position and an open position and in its closed position carries the current. An actuating member is connected electrically and mechanically in series with the switching member 22. The first external terminal 11 is connected to a planar cover electrode 12, to which the actuating member is fastened with its first end 25. The cover electrode 12 has on its inner side 32 a flat self-hold resistor that is electrically connected between the cover electrode 12 and the second external terminal 14.

21 Claims, 4 Drawing Sheets

SWITCH HAVING AN INSULATING SUPPORT

BACKGROUND OF THE INVENTION

1. Field of the Invention

The present invention concerns a switch having an insulating support on which a first and a second external terminal are arranged, and having a temperature-dependent switching mechanism that, as a function of its temperature, makes between the first and the second external terminal an electrically conductive connection for an electrical current to be conveyed through the switch, and comprises a switching member that changes its geometric shape in temperature-dependent fashion between a closed position and an open position, in its closed position the switching member carrying the current, an actuating member being provided that is connected electrically and mechanically in series with the switching member.

2. Related Prior Art

A switch of this kind is known from U.S. Pat. No. 4,636,766.

The known switch comprises, as the switching member, a U-shaped bimetallic element having two legs of different lengths. Attached to the long leg is a movable contact element that coacts with a switch-mounted countercontact that in turn is connected in electrically conductive fashion to one of the two external terminals.

The shorter leg of the U-shaped bimetallic element is attached to the free end of an actuating member, configured as a lever arm, that at its other end is joined immovably to the housing and is connected in electrically conductive fashion to the other of the two external terminals. The actuating member is a further bimetallic element that is matched with the U-shaped bimetallic element in such a way that when temperature changes occur, the two bimetallic elements deform in opposite directions and thus maintain the contact pressure between the movable contact element and the housing-mounted countercontact.

This switch serves as an interrupter for high currents which result in considerable heating of the bimetallic elements through which they flow, so that ultimately the movable contact element is lifted away from the fixed countercontact. Ambient temperature influences are compensated for by the aforementioned oppositely directed shaping of the bimetallic elements.

The principal disadvantage of this design is that two bimetallic elements, whose temperature characteristics must exactly match with one another, are required; this is difficult and cost-intensive to implement in design terms. In order to compensate for production tolerances, the known switch is moreover mechanically adjusted after assembly, which constitutes a further disadvantage.

Since the two bimetallic elements are of very different geometrical configuration, they also have different long-term stability properties, so that readjustment would in fact be necessary from time to time. This is no longer possible during service, however, the overall result being that long-term stability and therefore operating reliability leave much to be desired.

A further disadvantage with this design is the large overall height necessitated by the U-shaped bimetallic element.

Lastly, a further disadvantage with this switch is that it automatically closes again after cooling off, i.e. has no self-hold function that prevents re-closing and thus reactivation of the electrical device protected by the switch.

Switches with a self-hold function are commonly known; with them, a self-hold resistor is connected between the two external terminals, in parallel with the temperature-dependent switching mechanism. When the switch is in the closed state, the self-hold resistor is electrically short-circuited through the switching mechanism, so that it carries no current. If the switching mechanism opens, however, a residual current flows through the self-hold resistor which thereby heats up, as a function of the applied voltage and its resistance value, to such a point that it holds the temperature-dependent switching mechanism at a temperature above the response temperature, so that it remains open.

The prior art discloses a lot of designs for the self-hold resistor in which a block-shaped PTC resistor is used, resulting in an increase in the geometrical dimensions as compared to a switch exhibiting no self-hold function.

A further disadvantage that is associated with the known switches having a self-hold function consists in the design outlay, which results in cost-intensive switches that are difficult to assemble.

A further disadvantage associated with the switch mentioned at the outset is the fact that the threshold value of the current that results in opening of the switch is determined by the ohmic resistance of the bimetallic element, so that it is difficult to implement different switching current values.

It is already known from the prior art, however, to adjust the current dependency by using a dropping or heating resistor that is connected electrically in series with the temperature-dependent switching mechanism. In the known switches, however, an actuating member in the form of a spring snap disk, etc., through which the electrical current flows, is connected in parallel with the switching member. In other words, in current-dependent switches with a dropping resistor the bimetallic element experiences no current, and the operating current of the electrical device being protected is conveyed through a separate spring element. By selecting the resistance value of this dropping or series resistor, the switching current value can now be adjusted accurately and reproducibly.

It is also the case with the known switches having a series resistor that the design outlay is disadvantageous and assembly of the switches is cost-intensive and time-consuming.

A further current-dependent switch known from EP 0 103 792 B1 has as the switching member a bimetallic spring tongue that is attached to one external terminal and carries at its free end a movable contact element that coacts with a countercontact that is arranged at the free end of an elongated spring element that is attached at the other end to the other external terminal, so that the current flows through the series circuit made up of the spring element and bimetallic spring tongue.

The elastic mounting of the countercontact ensures in this case that there is little mechanical load on the bimetallic spring tongue, since the countercontact deflects in limited fashion when the bimetallic spring tongue changes its geometric shape as a result of a temperature change. This prevents irreversible deformations of the bimetallic spring tongue that might result in a shift in the switching temperature.

One disadvantage of this switch is the fact that during the transition from the closed to the open position, the bimetallic spring tongue, like all bimetallic elements, passes through a "creep" phase in which the bimetallic element deforms in creeping fashion in response to an increase or decrease in temperature, but without yet snapping over from its, for example, convex low-temperature position into its concave high-temperature position. This creep phase occurs whenever the temperature of a bimetallic element approaches the kickover temperature either from above or from below, and results in appreciable conformational changes. In addition, the creep behavior of a bimetallic element can also change, in particular, as a result of aging or long-term operation.

During the opening movement, creep can result in a weakening of the pressure of the contact against the countercontact, thus causing undefined switching states. During the closing movement, the contact can gradually approach the countercontact during the creep phase, which can lead to the risk of arcing.

The problems associated with the creep behavior of a bimetallic element are solved, in a current-dependent switch such as described in the aforementioned U.S. Pat. No. 4,636,766 or in EP 0 103 792, by the fact that the bimetallic spring tongues are equipped with dimples with which the creep phase is not completely but at least for the most part suppressed. These dimples or other mechanical impressions provided for suppressing the creep phase onto the bimetallic element are complex and expensive features which moreover greatly reduce the service life of these bimetallic elements. A further disadvantage of the requisite dimple is that not only different material compositions and thicknesses, but also different dimples, must be used for various power classes and response temperatures.

SUMMARY OF THE INVENTION

In view of the above, it is an object of the present invention to equip a switch of the kind mentioned at the outset, which avoids the aforesaid disadvantages, with a self-hold function in the context of an economical and simple design; the switch is to have a compact construction, excellent operating reliability, and a long service life.

In the case of the switch mentioned at the outset, this object is achieved in that the first external terminal is connected to a planar cover electrode, to which the actuating member is fastened with its first end and on whose inner side is arranged a flat self-hold resistor that is electrically connected between the cover electrode and the second external terminal.

The object underlying the invention is completely achieved in this fashion.

Specifically, the inventor of the present application has recognized that it is possible, when using a planar cover electrode, to arrange a flat self-hold resistor on its inner side without perceptibly influencing the overall height. The reason is that, in contrast to a block-shaped PTC element, a resistor of this kind, for example a film resistor, has so little thickness that it results in a barely perceptible increase in the thickness of the cover electrode.

It is particularly preferred in this context if the actuating member is a spring element whose displacing force or resilience is largely independent of temperature, and if the actuating member has a temperature-dependent displacing force or resilience that, in its creep phase, is greater than the displacing force of the spring element.

The inventor of the present application has recognized that the mechanically and electrically parallel arrangement, known for example from DE 21 21 802 C, of the temperature-neutral spring element and switching member can be converted into an electrical and mechanical series circuit and used in the new switch in order to combine a number of further advantages in the new switch.

The reason is that because of the mechanical series circuit, i.e. the fact that the spring force of the spring element coacts with that of the switching member, the creep phase of the switching member can be compensated for. When the geometry of the switching member changes during the creep phase, this is immediately compensated for by the spring element. It is therefore now possible for the first time, even in the case of a switch having a switching member through which current flows (which can be a bimetallic or trimetallic element), to allow a large creep phase for the switching member, since the spring element can compensate for the "undesired" changes in shape during the creep phase. This means, however, that a more easily manufactured and therefore more economical switching member, which moreover has a longer service life, can be used, since dimpling can be largely dispensed with and a greater hysteresis thus becomes permissible, so that the creep phase can be maximally utilized.

As a result, however, not only are fewer geometrical demands placed on the switching member, but there are also fewer requirements in terms of the spring element, since the latter now needs only to ensure that the switching member remains, below its kickover temperature (i.e. during the creep phase), in electrical contact with one of the external terminals. Switch types that differ in terms of power class and response temperature can now be designed with substantially the same spring element but different switching members; these components of the switching mechanism are subject to much fewer geometrical and mechanical conditions, so that all in all they can be manufactured more easily and more economically.

In terms of the service life of the switching member, the advantages obtained here are the same as in the case of the loosely laid-in bimetallic snap disk disclosed by DE 21 21 802 C. All in all, with the new switch more emphasis can be placed on electrical properties and on switching temperature; for the first time in the art, the mechanical spring force of the switching member plays a subordinate role, since it needs to be only sufficient that the switching member is not too greatly compressed by the spring element. The switching process itself is effected, after completion of the creep phase, solely by the switching member, which is now always preloaded in its creep position. This preloaded switching member exhibits a number of further advantages: for example, it does not vibrate in a magnetic field and it presents no risk of arcing, since any gradual opening or closing of contacts is prevented by the preload.

This means that only a very slight dimpling of the bimetallic element, which merely needs to ensure the snap effect for sudden contact separation, is necessary. A more pronounced dimpling, as was used hitherto to reinforce or suppress the creep phase, is no longer necessary. Mechanical loads are thereby reduced, and the service life and the reliability and reproducibility of the switching point are thus greatly increased.

The temperature-neutral spring element no longer exerts on the bimetallic element any pressure which prevents its deformation; instead, in the creep phase it compensates for the deformation of the bimetallic element by way of its own deformation, in such a way that the movable contact element and fixed countercontact remain securely in contact with one another so as to ensure a low contact resistance. Below the switching temperature, the contact pressure remains constant largely independent of temperature.

The creep phase of the bimetallic element is thus no longer suppressed as in the prior art, but rather, so to speak, compensated for, since the bimetallic element can deform in almost unimpeded fashion in the creep phase, the changes in geometry being compensated for by the spring element in such a way that the switch remains securely closed.

For this purpose, the temperature-dependent displacing force of the bimetallic element is selected so that in the creep phase it is greater than the largely temperature-neutral displacing force of the spring element, which thus simply "guides" the accordingly "rigid" bimetallic element.

One great advantage of the new switch lies in its simple design: in addition to a housing-mounted countercontact, only one bimetallic element is required, and the spring element is temperature-neutral and thus economical. All in all, although the bimetallic element and spring element do need to be coordinated with one another in terms of displacing force, they no longer must be additionally coordinated in terms of their temperature behavior, since the switching mechanism, so to speak, aligns itself. This makes possible one standard spring element for all temperature ranges, thus achieving a substantial rationalization effect. This design moreover makes it possible to achieve a low overall height, and individual readjustment is not necessary for different switching temperatures: the bimetallic element merely needs to be designed with the same spring properties but different switching temperatures.

A further advantage is the fact that tolerances and fluctuations in switching temperature are compensated for by the guidance achieved by way of the temperature-neutral spring element.

In an improvement, it is preferred if the second external terminal is connected to a bottom electrode which coacts with a movable contact element that is provided on the switching member; and if there is arranged between the cover electrode and the base electrode a connecting element that connects the self-hold resistor to the bottom electrode.

This feature is advantageous in terms of design: the connecting element can either be placed into the switch as a separate part during assembly, or can previously be attached to the cover electrode or bottom electrode. Complex solder joins or electrical wire connections are thus not necessary for making contact to the self-hold resistor.

It is further preferred if there is arranged on the inner side of the cover electrode a flat series resistor that is connected electrically between the first external terminal and the first end of the spring element.

The advantage of this feature is that the current dependency is now determined no longer only by the switching member through which current flows, but rather principally by the series resistor, which can be mounted, for example, geometrically parallel to the self-hold resistor on the inside of the cover electrode. In order now to produce switches with different current dependencies, all that is necessary is to keep in stock different cover electrodes with different resistance values for the series resistor; the other components of the switch can remain unchanged. The resistance value of the self-hold resistor can now also easily be adapted, in what might be called the "preform" production stage, in such a way that it ensures reliable self-hold behavior at different response currents for the switch, which generally also involve different residual currents in the open state.

It is further preferred in this context if there is arranged on the inner side of the cover electrode an insulating film on which is arranged at least one resistive path that is connected at one end to the first external terminal and at the other end to a contact surface with which a contact region of the connecting element or on the spring element is in contact.

This feature is advantageous in terms of design, since the connection between the self-hold resistor (and optionally the series resistor) on the inner side of the cover electrode, and the associated contact surfaces on the connecting element or the first end of the actuating member, is accomplished, when the cover part is placed onto the insulating support, "simultaneously" with the mechanical attachment of the cover electrode to the insulating support. Assembly of the new switch is thus simple and economical.

It is further preferred if the connecting element is a contact plate, resting on the insulating support, that is in contact with the contact surface; and has contact clips, facing toward the bottom electrode, that clamp between them a tab or tongue that is elevated or stands up from the bottom electrode.

This feature is also advantageous in terms of design, since after the bottom electrode has been injection-embedded into, for example, the insulating support, the connecting element is inserted into an opening, provided for it, into which the tab of the bottom electrode projects upward from below, the tab being clamped between its contact clips. All that must be done next is to set the cover electrode in place in order to make the connection between the connecting element and the self-hold resistor.

It is further preferred in this context if the spring element is configured at its first end in a T-shape, rests with that T-shaped end on the insulating support, and has at that T-shaped end a contact region that is in contact with the contact surface of the series resistor.

This feature is also advantageous in terms of design, since it simplifies assembly of the new switch even further. All that must be done next is to place the spring element onto the insulating support, on which the bottom electrode is already retained in lossproof fashion by injection-embedding, and into which the connecting element has optionally already been placed; the spring element is thereby braced with its T-shaped end on the insulating support. The switching member, attached mechanically to the other end of the actuating member, thus comes to rest in a corresponding opening in the insulating support. Now the cover electrode simply needs to be set in place, which causes the contact surfaces provided thereon to come into contact with the contact surface on the T-shaped end and optionally with the connecting element.

Next, a rim of the insulating support is hot-pressed, thus holding the cover electrode in mechanically immovable fashion on the insulating support and at the same time creating the necessary electrical connections. There is moreover no need for readjustment or alignment of the switching mechanism, since it aligns itself, so to speak, automatically in the insulating support as a result of the displacing force of the spring element.

Note also that this assembly operation is greatly simplified as compared, for example, to the assembly of a switch as defined in DE 21 21 802 C, since the operation therein, to be performed only manually, of setting in place the bimetallic snap disk and the spring disk slipped over it is highly wage-intensive and moreover often results in wastage. With the new switch, however, there are no problems with assembly due to the mechanical join between the spring element and switching member; in particular, the spring element and switching member cannot slip with respect to one another.

It is preferred in this context if the spring element and the switching member are substantially flat, sheet-like parts that extend away from their joining point in a V-shape toward the same side.

The advantage of this feature is that overall height is greatly reduced as compared to the generic switch, and a lesser longitudinal extension is also achieved because of the "folded-back" free end of the switching member.

Further advantages are evident from the description of the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the drawings and will be explained in more detail in the description below. In the drawings.

DETAILED DESCRIPTION OF A PREFERRED EMBODIMENT

Figure 1:
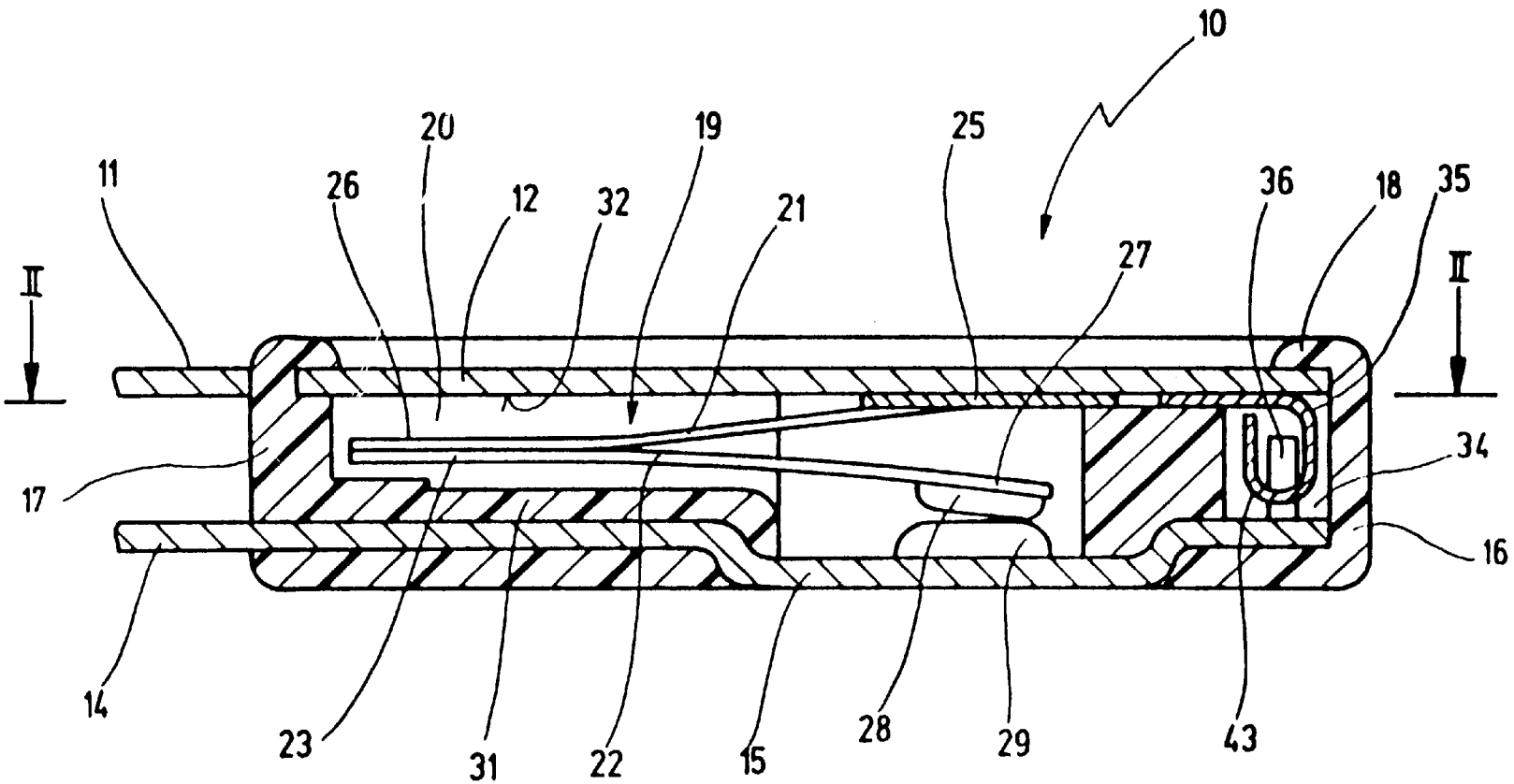
FIG. 1 shows a longitudinal section through the new switch along line I—I of FIG. 2.

In FIG. 1, reference numeral 10 generally designates a new switch, which is shown in schematic longitudinal section.

The new switch 10 has a first external terminal 11 that is joined integrally to a flat or planar cover electrode 12. Also provided is a second external terminal 14 that is configured integrally with a bottom electrode 15. Cover electrode 12 and bottom electrode 15 are retained on an insulating support 16 that holds cover electrode 12 and bottom electrode 15 spaced apart parallel to one another.

While insulating support 16 can theoretically be open laterally, FIG. 1 shows an embodiment in which insulating support 16 comprises a cup-shaped lower housing part 17 that is configured around bottom electrode 15, by injection embedding or encapsulation, in such a way that bottom electrode 15 is an integral constituent of lower housing part 17. Lower housing part 17 is closed off by cover electrode 12 and is held in lossproof fashion by a hot-welded rim, indicated at 18, of insulating support 16.

A temperature-dependent switching mechanism 19 is arranged between cover electrode 12 and bottom electrode 15 in a first interior space 20 of insulating support 16. Switching mechanism 19 comprises a mechanical and electrical series circuit made up of a spring element 21 and a switching member 22, which are joined to one another by way of a join indicated at 23. In the present case, switching member 22 is a bimetallic element.

Spring element 21 has a largely temperature-independent displacing force or resilience; in the context of the present invention, this means that the displacing force or spring force of spring element 21 does not change appreciably within the allowable operating temperature range of switch 10. The displacing force of the bimetallic element, on the other hand, is highly temperature-dependent, and even in the so-called creep phase is already sufficient that spring element 21 cannot exert any pressure capable of preventing deformation of the bimetallic element on the bimetallic element, which in this spring system is therefore to be regarded as rigid at constant temperature.

Spring element 21 is in contact at its first, T-shaped end 25 (at the top right in FIG. 1) with cover electrode 12, and at its second end 26 leads into join 23 to switching member 22. Switching member 22 carries at its free end 27 a movable contact element 28 that coacts with a switch-mounted countercontact 29 that is configured on bottom electrode 15.

In its closed position shown in FIG. 1, switching mechanism 19 makes an electrically conductive connection between cover electrode 12 and bottom electrode 15. When a temperature rise occurs, movable countercontact 28 lifts away from fixed countercontact 29, so that join 23 moves downward in FIG. 1 and as a result comes to rest on an insulating bridge 31 that prevents short-circuiting with bottom electrode 15.

In a manner yet to be described, a self-hold resistor and a series resistor are arranged on cover electrode 12 on its inner side 32, the self-hold resistor being connected electrically between cover electrode 12 and bottom electrode 15, and the series resistor being connected electrically between first external terminal 11 and second end 25 of spring element 21.

A second interior space 34, into which projects from above a connecting element 35 that is in electrical contact with a bent-up tab 36 of bottom electrode 15, is provided in insulating support 16. In a manner yet to be described, connecting element 35 is also in contact with the self-hold resistor, as will be explained now with reference to FIG. 2.

Figure 2:
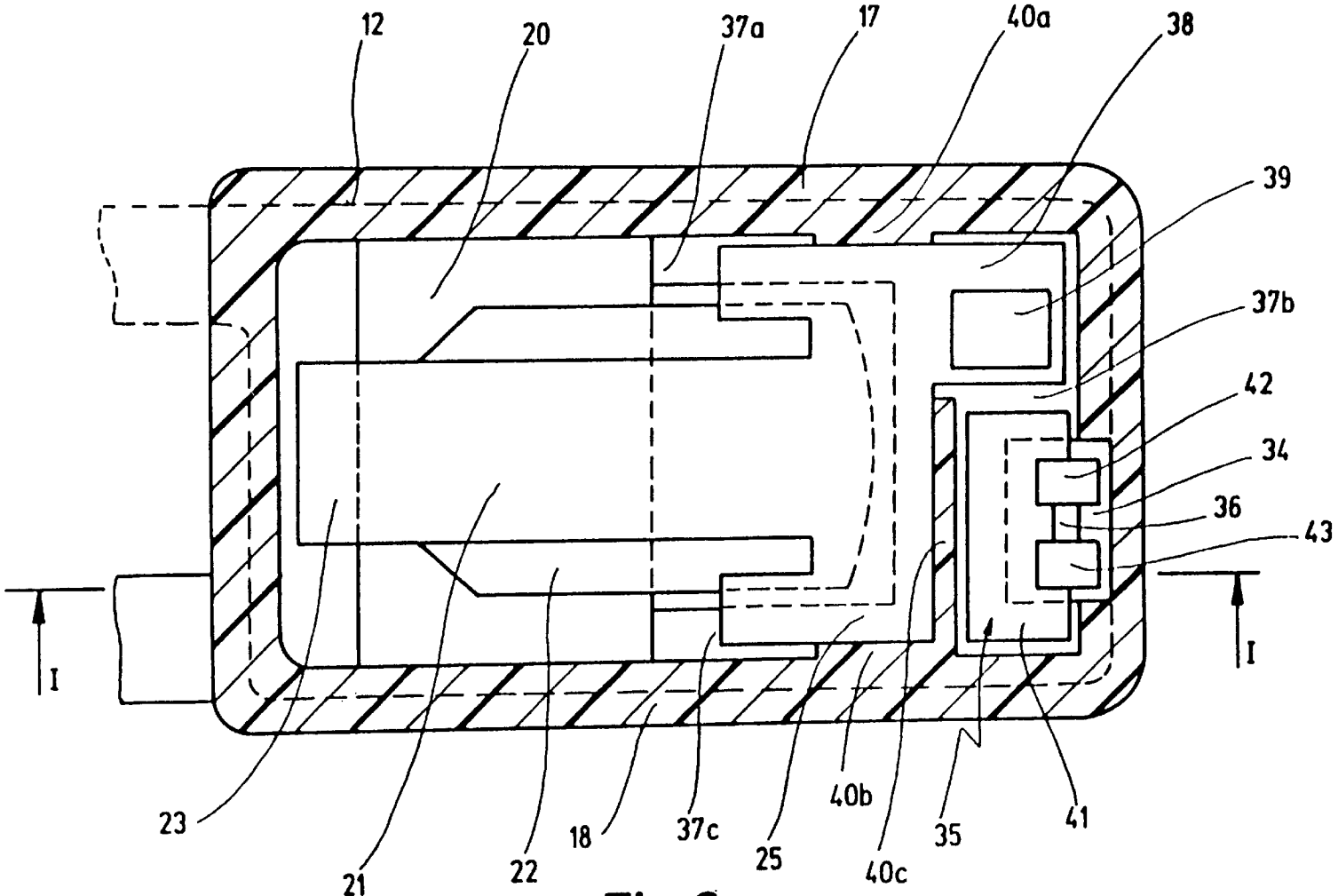
FIG. 2 shows a plan view of the switch according to FIG. 1, sectioned along line II—II of FIG. 1.

It is firstly evident from FIG. 2 that lower housing part 17 has a base 37, shown as parts 37*a*, 37*b*, 37*c*, set back downward with respect to its rim, on which rests the T-shaped second end 25 of spring element 21. This T-shaped second end 25 has an extension 38 on which a contact surface 39 is provided for making contact to the series resistor.

Note also that T-shaped end 25 is prevented from sliding on base 37 by projections 40*a*, 40*b*, and 40*c*.

Figure 3A:
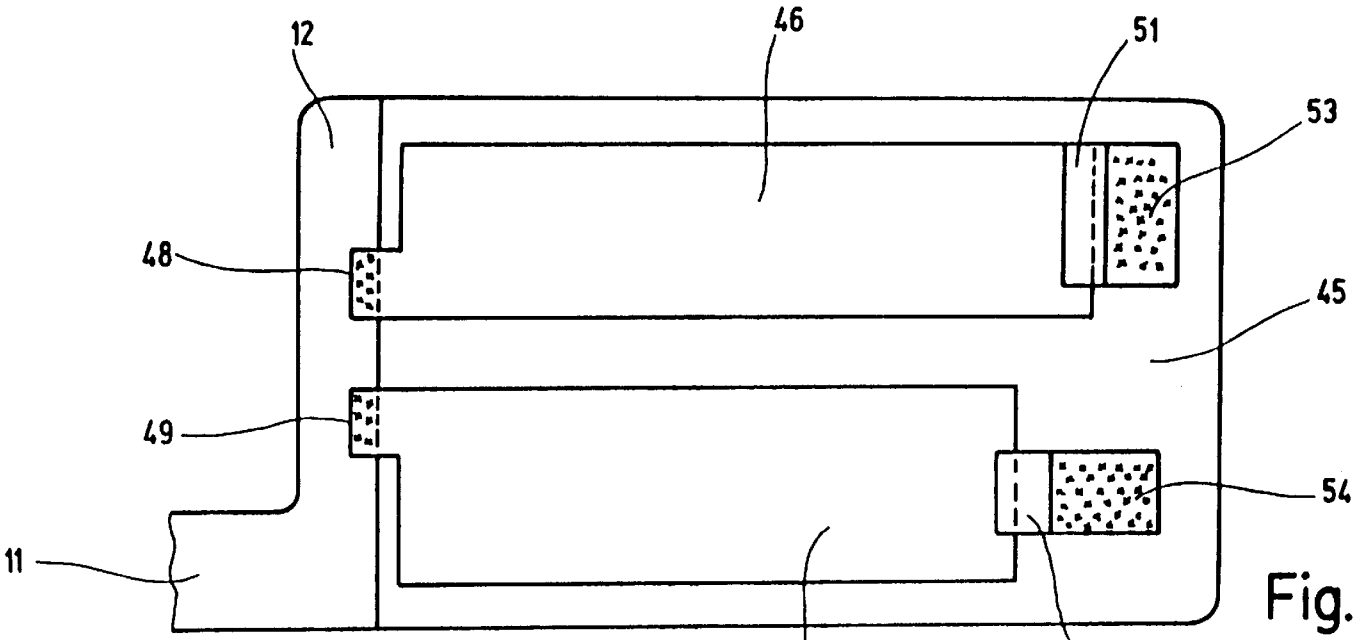
FIG. 3*a* shows a plan view of the inner side of the cover electrode of the switch of FIG. 1.

Also resting on base 37*b*, in addition to extension 38, is a contact plate 41 of connecting element 35. Two contact clips 42, 43, which clamp tab 36 of bottom electrode 15 between them, extend downward from contact plate 41. Contact plate 41 comes into contact with the self-hold resistor, as will now be explained with reference to the bottom view of cover electrode 12 in FIG. 3*a*.

Cover electrode 12 is first equipped over a large area with an insulating film 45, on which a resistive path constituting a self-hold resistor 46, and a resistive path constituting a series resistor 47, are applied geometrically parallel to one another. At their left end these resistive paths are equipped with connector elements 48 and 49, respectively, which make an electrical connection to cover electrode 12 and thus to first external terminal 11.

At their other end, the resistive paths are equipped with connector elements 51, 52 that terminate in contact surfaces 53 and 54, respectively.

Self-hold resistor 46 comes into contact with contact plate 41 via contact surface 53, so that self-hold resistor 46 is connected between cover electrode 12 and bottom electrode 15 when cover electrode 15 is resting on insulating support 16.

When cover electrode 12 is set in place, contact surface 54 comes into contact with contact surface 39, so that series resistor 47 is connected electrically in series between first external terminal 11 and spring element 21.

Figure 3B:
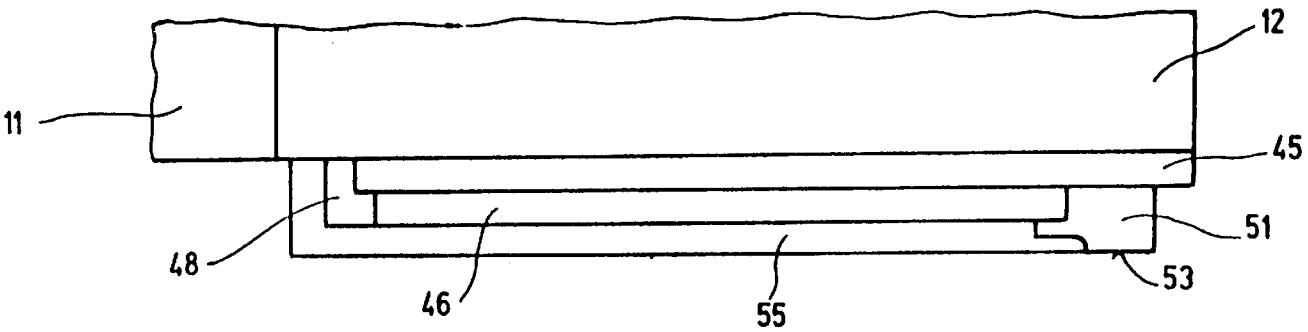
FIG. 3*b* shows a side view of the cover electrode of FIG. 3*a;*

The film-like arrangement of self-hold resistor 46 and series resistor 47 on the inner side of cover electrode 12 is shown, in the side view of FIG. 3*b*, in a highly enlarged representation that is not to scale.

Switch 10 is assembled by first injection-embedding bottom electrode 15 into insulating support 16, leaving the two interior spaces 20 and 34 open. Switching mechanism 19 is then placed into interior space 20 in such a way that T-shaped end 25 of spring element 21 comes to rest on base 37. Connecting element 35 is then slid into second interior space 34, tab 36 being clamped between contact clips 42 and 43.

Cover electrode 12, equipped with self-hold resistor 46 and optionally with series resistor 47, is then placed from above onto insulating support 16, contact surface 53 thereby coming into contact with contact plate 41, and contact surface 54 with contact surface 39, in such a way that switch 10 is equipped with a dropping resistor and with a self-hold resistor.

During this assembly operation, switching mechanism 19 "automatically" aligns itself in first interior space 20; spring element 21 compensates for the pressure on switching member 22 in such a way that a secure or reliable connection is made between movable contact 28 and fixed countercontact 29.

The relationships between the displacing forces of spring element 21 and switching member 22 will now be explained with reference to FIGS. 4 through 6.

Figure 4:
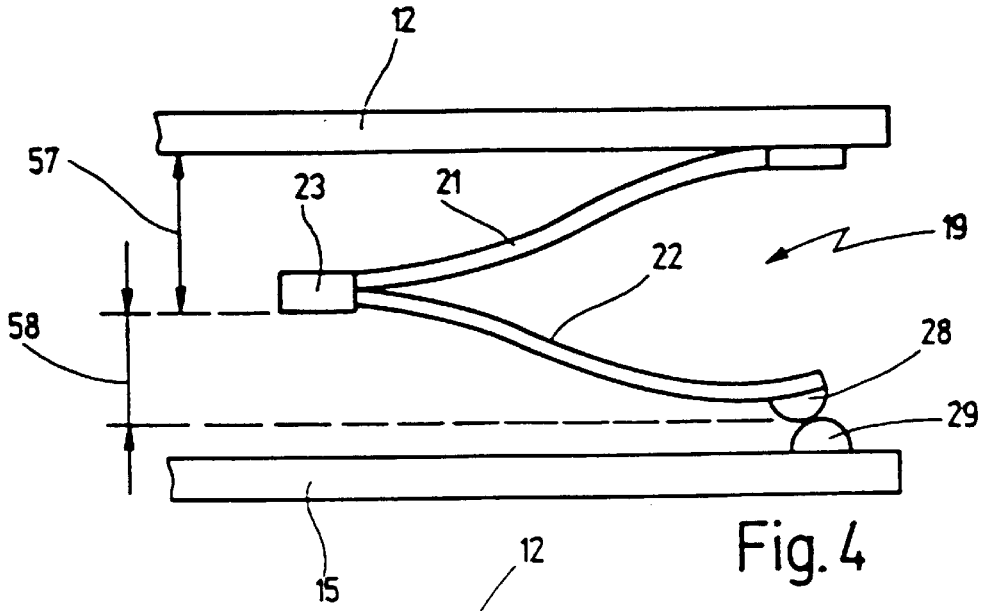
FIG. 4 shows the switching mechanism of FIG. 1 in a schematized, enlarged representation, the switching member being in the closed position.

For this purpose, FIG. 4 shows switching mechanism 19 of FIG. 1, schematically and at enlarged scale, in its closed position. Switching member 22 is so far below its kickover temperature that its creep phase has not yet begun. Switching member 22 presses join 23 upward in FIG. 4 against the force of spring element 21, thus establishing a spacing from cover electrode 12 indicated at 57, and a spacing from countercontact 29 indicated at 58.

Figure 5:
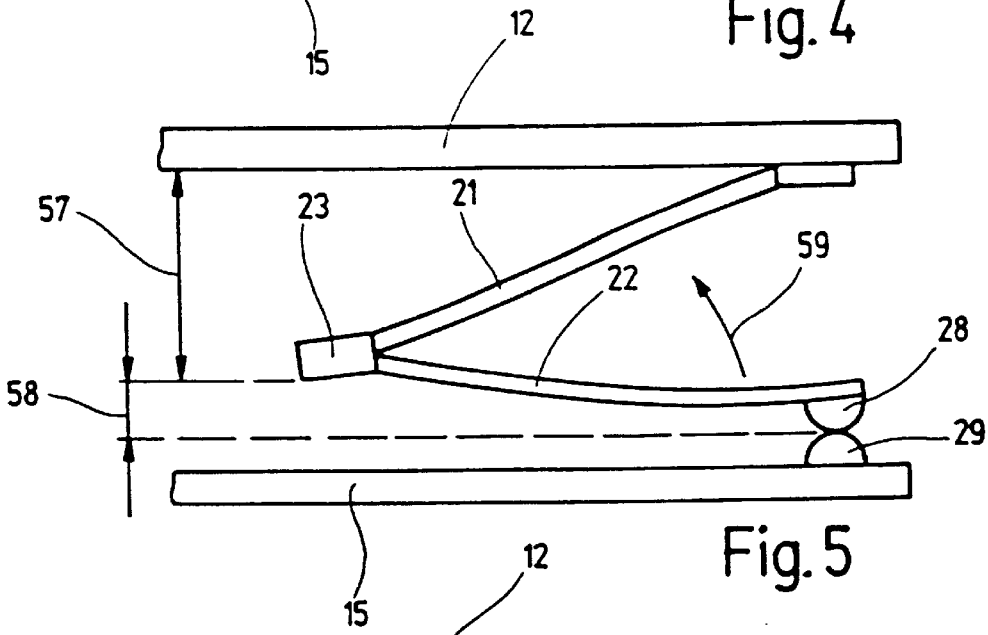
FIG. 5 shows a representation like FIG. 4, but during the creep phase of the switching member.

If the temperature of switching member 22 then rises, because of an increased current flow and thus increased heating of series resistor 47 or because of an increased outside temperature, which can be coupled in both via cover electrode 12 and via bottom electrode 15, initially the creep phase of switching member 22 then begins; in this, its spring force acting against the force of spring element 21 weakens, so that join 23 is moved downward in FIG. 4, as shown in FIG. 5. The displacing force of the bimetallic element is, however, still so great that the displacing force of spring element 21 is not sufficient to prevent the deformations that occur in the creep phase. Regardless of its changes in geometry in the creep phase, the switching member is to be regarded as rigid by comparison with spring element 21; the contact pressure is exerted solely by the displacing force of the spring element.

Spacing 57 increases to the same extent that spacing 58 decreases. The mechanical series circuit made up of spring element 21 and switching member 22 continues, however, to push movable contact element 28 against countercontact 29. A comparison between FIGS. 4 and 5 reveals, however, that movable contact element 28 has shifted transversely in FIG. 5 with respect to countercontact 29. This friction is desirable, since the contact surfaces between contact element 28 and countercontact 29 are thereby cleaned, so that the electrical contact resistance is very low.

Figure 6:
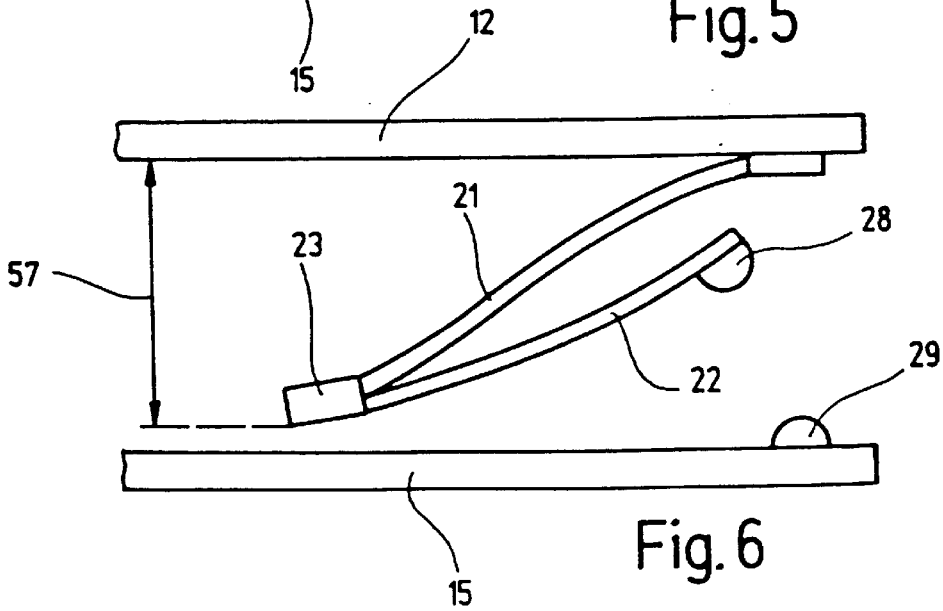
FIG. 6 shows a representation like FIG. 4, but with the switching member in its open position.

If the temperature of switching member 22 then increases further, it snaps in the direction of an arrow 59 into its open position shown in FIG. 6. Join 23 has moved even farther downward, and switching member 22 has lifted movable contact element 28 away from countercontact 29. A comparison between FIGS. 4 and 6 reveals that join 23 between cover electrode 12 and bottom electrode 15 moves downward, while movable contact element 28 moves upward in the opposite direction, so that the clearance between cover electrode 12 and bottom electrode 15 is, so to speak, utilized twice over.

In the position shown in FIG. 6, a residual current now flows through self-hold resistor 46, creating a corresponding amount of heat that is sufficient to hold switching member 22 in its high-temperature position as shown in FIG. 6.

It is further evident from FIGS. 4 through 6 that spring element 21 and switching member 22 are substantially flat, sheet-like parts that are arranged in a V-shape, i.e. extend out toward the same side from their join 23. This "folded-back" arrangement makes possible not only the aforementioned double utilization of the spacing between cover electrode 12 and bottom electrode 15, but also a relatively short configuration for the new switch 10.

Therefore, what I claim, is:

1. A switch for conducting an electrical current, comprising a first external terminal and a planar cover electrode having a flat inner side and being connected to said first external terminal, a second external terminal, an insulating support, the first and second external terminals being arranged at said insulating support, a temperature-dependent switching mechanism having a switching member changing its geometric shape in temperature-dependent fashion between a closed position and an open position, and an actuating member having a first end and being connected electrically and mechanically in series with the switching member and being fastened with its first end to said flat inner side of the planar cover electrode, such that, as a function of its temperature said switching mechanism makes an electrically conductive connection for said current between said first and second external terminals, and a flat self-hold resistor immediately arranged at said flat inner side of planar cover electrode and being permanently electrically connected between the cover electrode and the second external terminal.

2. The switch as in claim 1, wherein the actuating member comprises a spring element having a displacing force that is largely independent of temperature, and the switching member has a temperature-dependent displacing force that, in a creep phase of the switching element, is greater than the displacing force of the spring element.

3. The switch as in claim 2, wherein there is arranged on the inner side of the cover electrode a flat series resistor that is connected electrically between the first external terminal and a first end of the spring element.

4. The switch as in claim 3, wherein there is arranged on the inner side of the cover electrode an insulating film on which is arranged at least one resistive path that is connected at one end to the first external terminal and at the other end to a contact surface with which a contact surface on the spring element is in contact.

5. The switch as in claim 4, wherein the connecting element is a contact plate, resting on the insulating support, that is in contact with the contact surface of the self-hold resistor and has contact clips, facing toward the bottom electrode, that clamp between them a tab that is elevated from the bottom electrode.

6. The switch as in claim 4, wherein the spring element is configured at its first end in a T-shape, rests with that T-shaped end on the insulating support, and has at that T-shaped end a contact surface that is in contact with the contact surface of the series resistor.

7. The switch as in claim 1, wherein the second external terminal is connected to a bottom electrode that coacts with a movable contact element that is provided on the switching member; and a connecting element that connects the self-hold resistor to the bottom electrode is arranged between the cover electrode and the bottom electrode.

8. The switch as in claim 7, wherein there is arranged on the inner side of the cover electrode an insulating film on which is arranged at least one resistive path that is connected at one end to the first external terminal and at the other end to a contact surface with which a contact surface of the connecting element is in contact.

9. The switch as in claim 8, wherein there is arranged on the inner side of the cover electrode an insulating film on which is arranged at least one resistive path that is connected at one end to the first external terminal and at the other end to a contact surface with which a contact surface on the spring element is in contact.

10. The switch as in claim 8, wherein the connecting element is a contact plate, resting on the insulating support, that is in contact with the contact surface of the self-hold resistor and has contact clips, facing toward the bottom electrode, that clamp between them a tab that is elevated from the bottom electrode.

11. The switch as in claim 10, wherein the spring element is configured at its first end in a T-shape, rests with that T-shaped end on the insulating support, and has at that T-shaped end a contact surface that is in contact with the contact surface of the series resistor.

12. A switch for conducting an electrical current, comprising a first external terminal and a planar cover electrode having an inner side and being connected to said first external terminal, a second external terminal, an insulating support, the first and second external terminals being arranged at said insulating support, a temperature-dependent switching mechanism having a switching member changing its geometric shape in temperature-dependent fashion between a closed position and an open position, and an actuating member having a first end and being connected electrically and mechanically in series with the switching member and being fastened with its first end to said inner side of the planar cover electrode, such that, as a function of its temperature said switching mechanism makes an electrically conductive connection for said current between said first and second external terminals, wherein the actuating member comprises a spring element having a displacing force that is largely independent of temperature; and the switching member has a temperature-dependent displacing force that, in a creep phase of the switching element, is greater than the displacing force of the spring element, and a flat self-hold resistor is arranged at said inner side of said planar cover electrode and electrically connected between the cover electrode and the second external terminal.

13. The switch as in claim 12, wherein the spring element and the switching member are substantially flat, sheet-like parts that extend away from their joining point in a V-shape toward the same side.

14. The switch as in claim 12, wherein the second external terminal is connected to a bottom electrode that coacts with a movable contact element that is provided on the switching member; and a connecting element that connects the self-hold resistor to the bottom electrode is arranged between the cover electrode and the bottom electrode.

15. The switch as in claim 14, wherein there is arranged on the inner side of the cover electrode a flat series resistor that is connected electrically between the first external terminal and a first end of the spring element.

16. The switch as in claim 15, wherein there is arranged on the inner side of the cover electrode an insulating film on which is arranged at least one resistive path that is connected at one end to the first external terminal and at the other end to a contact surface with which a contact surface on the spring element is in contact.

17. The switch as in claim 16, wherein the spring element is configured at its first end in a T-shape, rests with that T-shaped end on the insulating support, and has at that T-shaped end a contact surface that is in contact with the contact surface of the series resistor.

18. The switch as in claim 14, wherein there is arranged on the inner side of the cover electrode an insulating film on which is arranged at least one resistive path that is connected at one end to the first external terminal and at the other end to a contact surface with which a contact surface of the connecting element is in contact.

19. The switch as in claim 18, wherein there is arranged on the inner side of the cover electrode an insulating film on which is arranged at least one resistive path that is connected at one end to the first external terminal and at the other end to a contact surface with which a contact surface on the spring element is in contact.

20. The switch as in claim 18, wherein the connecting element is a contact plate, resting on the insulating support, that is in contact with the contact surface of the self-hold resistor and has contact clips, facing toward the bottom electrode, that clamp between them a tab that is elevated from the bottom electrode.

21. The switch as in claim 20, wherein the spring element is configured at its first end in a T-shape, rests with that T-shaped end on the insulating support, and has at that T-shaped end a contact surface that is in contact with the contact surface of the series resistor.

* * * * *